United States Patent [19]

Takahashi et al.

[11] 4,290,648

[45] Sep. 22, 1981

[54] MINING APPARATUS

[75] Inventors: Ken Takahashi, Tokyo; Tsunetoshi Ito, Yokohama, both of Japan

[73] Assignee: Taiheiyo Engineering Inc., Tokyo, Japan

[21] Appl. No.: 71,455

[22] Filed: Aug. 31, 1979

[30] Foreign Application Priority Data

Jun. 25, 1979 [JP] Japan ..... 54-79043

[51] Int. Cl.[3] ..... E21C 27/24; E21C 35/08

[52] U.S. Cl. ..... 299/1; 299/45

[58] Field of Search ..... 299/1, 45; 175/45

[56] References Cited

U.S. PATENT DOCUMENTS

| | | | |
|---|---|---|---|
| 3,333,893 | 8/1967 | Heimaster | 299/1 |
| 3,371,964 | 3/1968 | Weber | 299/1 |
| 3,719,394 | 3/1973 | Hartley | 299/1 |
| 4,072,349 | 2/1978 | Hartley | 299/1 |

FOREIGN PATENT DOCUMENTS

| | | | |
|---|---|---|---|
| 1165270 | 9/1969 | United Kingdom | 299/45 |
| 1203362 | 8/1970 | United Kingdom | 299/1 |

*Primary Examiner*—Ernest R. Purser

*Attorney, Agent, or Firm*—Jordan and Hamburg

[57] ABSTRACT

The present invention is directed to a mining apparatus which includes a position detection device comprising at least one projector and receiver to measure position of the apparatus in a mine by receiving projected signals reflected off an edge of the mine.

13 Claims, 5 Drawing Figures

MINING APPARATUS

BACKGROUND OF THE INVENTION

The present invention relates to a shearer for use in coal or metal mining and suitable for effecting the long wall mining method. More particularly, the present invention relates to a shearer provided with a device for detecting the position of a lower cutting drum according to the height which the long wall face of a coal or metal mine is cut by another upper cutting drum to always keep the mining height constant.

Ranging drum shearers are well known as conventional coal mining machines and the shearers of this kind can be divided into two groups, one of which is a single ranging drum shearer provided with a ranging arm only at one end of the shearer having a cutting drum, while the other is a double ranging drum shearer provided with ranging arms at both ends of the shearer having cutting drums.

Since the single ranging drum shearer has only one cutting drum, generally speaking, it is difficult to cut the whole height of the seam by one pass of said shearer. Accordingly, it is necessary to reciprocate the shearer along the pit face changing the height of the shearer every travel along the pit face.

On the other hand, the double ranging drum shearer has ranging arms provided at the front and back ends of shearer, each ranging arm having one cutting drum. Therefore, the preceding drum is positioned high to function as a drum for cutting the pit face at the side of the mine roof and the other succeeding drum is positioned low to function as another drum for cutting the pit face at the side of the mine floor, thus enabling the shearer to cut the entire seam height at one time.

In order to cut the pit face using the double ranging drum shearer, the operator must judge by himself whether or not the cutting operation is correct by viewing the top of cutting drum arranged at the side of the mine roof and the bottom of another cutting drum arranged at the side of the mine floor. The cutting operation of the drum arranged at the side of the mine roof provides no problem since the top of the drum can be easily viewed. However, the cutting operation of another drum arranged at the side of the mine floor depends on the skill of the operator since the bottom of the drum cannot be easily viewed because of the presence of coal previously cut by the preceding cutting drum and scattered on the mine floor and also because of the presence of a conveyor arranged on the mine floor along the pit face. Therefore, when the shearer is operated by an unskilled operator, the mine floor is either made uneven, having wave-formed concave-convex portions, or the distance between the mine roof and floor, i.e., the mining height, is exceeded by the maximum height of self-advancing supports or made lower than the minimum height of self-advancing supports, so that the working operation at the pit face is hindered and the mining efficiency is lowered.

In order to overcome the above-mentioned drawbacks, the inventors of present invention previously disclosed a new technique in their publicly opened Japanese Pat. No. 958,841. This technique comprises attaching a sensor to the head of a ranging arm of a cutting drum arranged at the side of the mine roof, said sensor to use the change in the elasticity of spring or oil pressure by the pantograph or diaphragm manner and arranged to contact and follow the mine roof surface to detect the change in the shape of the mine roof surface. Accordingly, the other cutting drum arranged at the side of the mine floor is raised or lowered responding to the signals transmitted from the sensor to thereby keep the mining height constant. However, according to this technique, the succeeding lower cutting drum is raised or lowered responding to the changes in the mine roof height detected by the sensor arranged to the preceding upper cutting drum, and the mining height is therefore not maintained accurately, because the preceding and succeeding cutting drums are arranged at both ends of the shearer body with a certain space interposed therebetween and the succeeding lower cutting drum is raised or lowered instantly responding to the information detected by the sensor which is arranged to the upper cutting drum preceding several meters ahead of the succeeding lower cutting drum. In addition, the sensor is affixed to the head of the ranging arm. Therefore, when the ranging arm is raised or lowered, the sensor is also raised or lowered at the same time, so that the sensor is slanted causing the measurement made by this slanted sensor to have errors. Further, the sensor employed by this technique is arranged to contact and follow the mine roof surface. However, it is difficult to cause the sensor to contact and follow the concave-convex surface of the mine roof accurately. In addition, an accident is easily happen in this case.

SUMMARY OF THE INVENTION

The present invention is intended to eliminate the above mentioned drawbacks. Accordingly, an object of present invention is to provide a coal mining machine wherein a sensor for measuring the distance to the mine roof is arranged to a cutting drum arranged at the side of the mine floor, whereby the mining operation can be effected keeping the mining height accurately constant.

Another object of present invention is to provide a coal mining machine provided with a device for detecting the position of a cutting drum, said device comprising a sensor arranged to move parallel in the vertical direction without rotating even when the ranging arm to which the sensor is attached is raised or lowered, whereby the measurement errors caused by the conventional slanted sensor are eliminated.

A further object of present invention is to provide a coal mining machine provided with a device for detecting the position of a cutting drum, said device which serves to function as a sensor for measuring the distance to the mine roof comprising a means for sending and receiving a ray or sound wave whereby the distance to the mine roof can be accurately measured and the occurrence of accident is eliminated.

A still further object of present invention is to provide a coal mining machine provided with a device for detecting the position of a cutting drum capable of easily keeping the mining height constant by automatic or manual control.

A still further object of present invention is to provide a coal mining machine provided with a device for detecting the position of a cutting drum wherein said device includes a parallel link means which includes a board to which the sensor for measuring the distance to the mine roof is attached and a ranging arm as two sides thereof, to prevent the sensor from being rotated or slanted whereby said device can be accurately operated even when the violent vibration of the coal mining machine or the impact of crumbling lumps or scattering pieces of coal is imparted to said device.

A still further object of present invention is to provide a coal mining machine provided with a device for detecting the position of a cutting drum wherein the board to which the sensor is attached is pivoted on the axial line of a drum rotating shaft of a ranging arm whereby the detection signals of the sensor can be used as the measurement value of distance to the mine roof without being corrected.

These and other objects as well as the merits of the present invention will be apparent from the following detailed description with reference to the accompanying drawings.

DETAILED DESCRIPTION OF PREFERRED EMBODIMENTS

Figure 1:
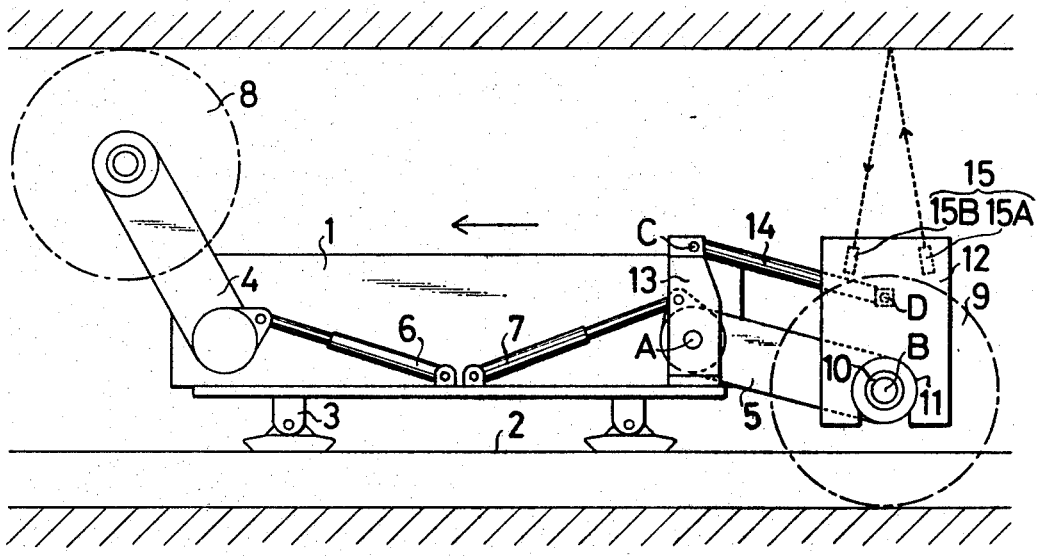
FIG. 1 is a front view showing an embodiment of the present invention.
Figure 2:
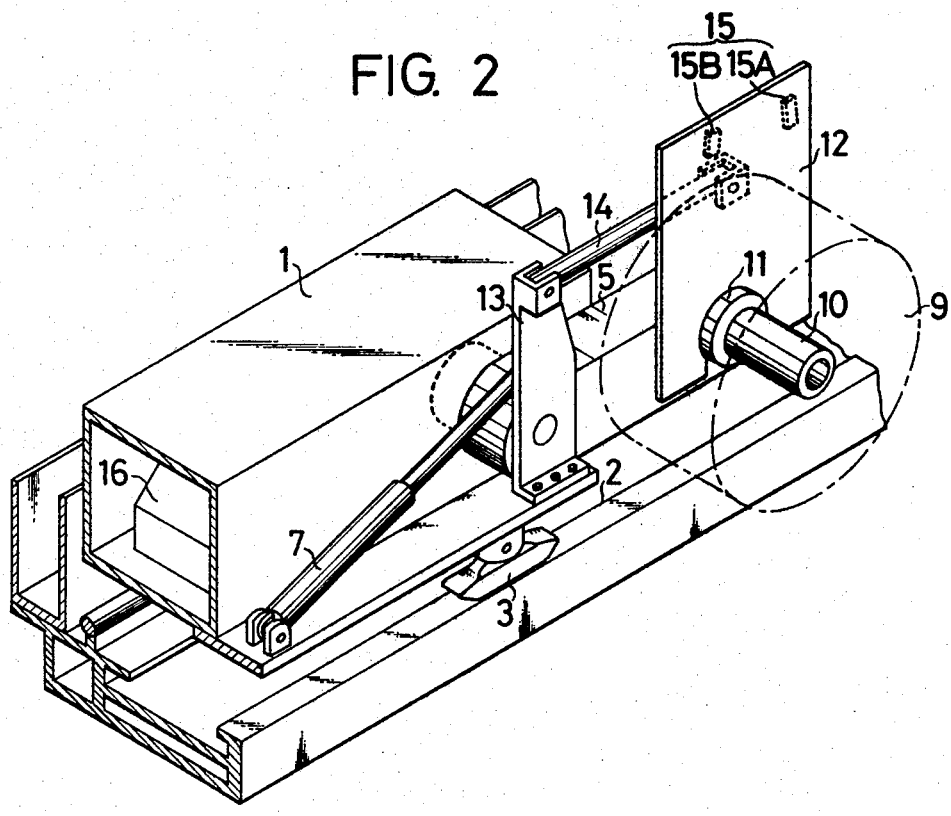
FIG. 2 is a partly broken isometric view showing the embodiment shown in FIG. 1.

FIGS. 1 and 2 show an example in which the present invention is applied to the double ranging drum shearer. Numeral 1 represents a shearer body, which is mounted on conveyors 2 with skids 3 interposed therebetween. In the shearer body 1, a means for driving cutting drums or the like is housed which will be described later. Numerals 4 and 5 represent ranging arms of which bottom ends are attached to both ends of shearer body 1, respectively. Numerals 6 and 7 denote ranging jacks, which serve to rotate the ranging arms 4 and 5. Numerals 8 and 9 denote cutting drums each being attached to the foremost end of the corresponding ranging arm through a rotating shaft 10. Numeral 11 represents a bearing housing by which the rotating shaft 10 is held. Numeral 15 denotes a device for detecting the position of a cutting drum, said device comprising a means 15A for projecting a ray, sound wave or the like and receivers 15B. The detection device 15 is arranged on a board 12, which is freely rotatably mounted on the bearing housing 11 of foremost end of a ranging arm 5. Numeral 13 represents a fixing plate erected on the shearer body 1 in front of bottom end of a ranging arm 5. Numeral 14 denotes a link bar, one end of which is pinned at a point C to the upper end of fixing plate 13 and the other end of which is pinned at a point D to the board 12. Points A, B, C and D are in the following positional relation. Namely, line A-B is equal in length and parallel to line C-D, and line A-C is equal in length and parallel to line B-D, thus forming a parallelogram. In this embodiment lines A-C and B-D are always kept vertical. As apparent from above, a parallel link mechanism is formed by the ranging arm 5, fixing plate 13, line bar 14 and board 12. Accordingly, even when the jack 7 is operated to change the slant angle of ranging arm 5, the board 12 on which the detection device 15 is arranged is changed in an angle relative to the ranging arm 5 to always keep line B-D vertical. In other words, the board 12 is vertically moved corresponding to the extent to which the cutting drum 9 is raised or lowered.

Though the positions of points A, B, C and D can be freely changed so far as these points occupy any of the apexes of parallelogram, it is desirable that the moving direction and amount of point D are equal to those of the center of the cutting drum 9. When point B is replaced in the direction of point A to form a parallelogram, the moving direction and amount of points B and D are not equal to those of the center of cutting drum 9, and therefore, it becomes necessary to add to the detection device 15 a complicated circuit or the like for correcting the measurement values. The above mentioned parallel link means of the present invention includes a kind of link means which does not form a parallelogram such as in the present invention, but has equal function the same as a parallel link in allowed measurement errors.

In the present invention, the detection device 15 comprises a sensor for measuring the distance to the mine roof which is attached to the board 12. This sensor includes a projector for projecting a ray, sound wave, supersonic wave or the like to the mine roof and receivers for receiving the reflected ray, sound wave, supersonic wave or the like. The sensor of this kind is publicly well known and the operation principle thereof is also publicly well known. Therefore, the sensor 15 employed in the present invention will not be described in detail but may be attached to the board 12 as described below.

Figure 3:
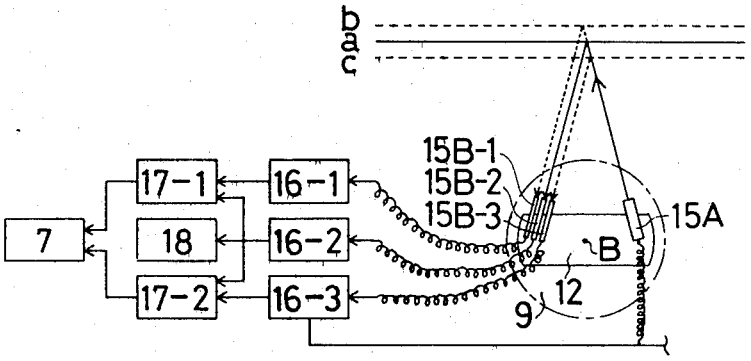
FIGS. 3 and 4 are block diagrams showing position detecting devices of the present invention.
Figure 4:
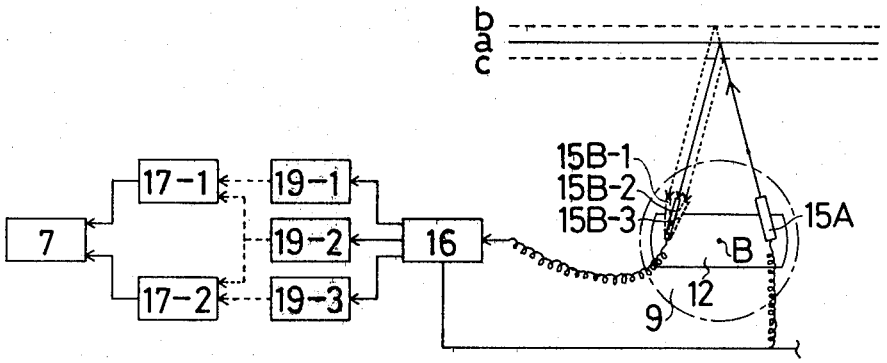

As shown in FIG. 3, at least one ray projector 15A and at least three ray receivers 15B-1, 15B-2, 15B-3 may be arranged in such a way that either of the ray receivers receives the reflected ray of ray projector 15A according to the heights (a), (b), (c) of the mine roof. As shown in FIG. 4, at least one ray projector 15A and at least one ray receiver 15B may also be arranged to the board 12 in such a way that the ray receiver 15B is turned to receive the reflected ray of ray projector 15A according to the heights of the mine roof and the turned position of ray receiver 15B is measured to display the distance to the roof. Namely, if the ray receiver 15B receives the reflected ray of ray projector 15A when the ray receiver 15B is in the position of 15B-1, it will be detected that the height of mine roof is (b). In the same way, if the ray receiver 15B receives the reflected ray of ray projector 15A in the position of 15B-2, the height of mine roof is (a), and if the ray receiver receives the reflected ray of ray projector in the position of 15B-3, the height of mine roof is (c). Though the sensor comprises a ray projector and ray receivers in this embodiment, a wave sending a receiving means may of course be employed.

The coal mining machine of present invention can be operated manually or automatically. The arrangement which is intended to keep the distance to the mine roof (or the mining height) constant after the distance to the roof is measured by the wave sending and receiving means or ray projecting and receiving device 15 may be optional. An arrangement which is intended to automatically raise or lower the cutting drum 9 arranged at the side of the mine floor is shown in FIG. 3, for example. Description will be made with reference to FIG. 3. When the height of the mine roof is (a), the ray projected from the ray projector 15A is received by the ray receiver 15B-2 and the position of cutting drum 9 at this time is the mining height to be set.

When the height of mine roof is now (b), the ray projected from the ray projector 15A is received by the ray receiver 15B-1, a signal is applied as an input from the ray receiver 15B-1 to a controller 16-1, an electromagnetic valve 17-1 for raising the cutting drum 9 is opened, and the jack 7 causes the ranging arm to be rotated in the upper direction. When the cutting drum 9 is raised by this rotation of ranging arm 5, the board 12 is also raised equal to the raised extent of cutting drum 9 to come closer to the mine roof, thus causing the ray from the ray projector 15A to be now received by the ray receiver 15B-2. A signal is then applied as an input to a controller 16-2, a neutral display lamp 18 is turned on and the electromagnetic valve 17-1 is closed at the same time, thus causing the cutting drum 9 to be held at the position to be set. When the distance to the mine roof becomes shorter, i.e., the height of mine roof becomes (c), the ray projected from the ray projector 15A is received by the ray receiver 15B-3, a signal is applied as an input to a controller 16-3, an electromagnetic valve 17-2 for lowering the cutting drum 9 is opened, and the jack 7 causes the ranging arm 5 to be rotated in the lower direction. When the cutting drum 9 is lowered by this rotation of arm 5, the board 12 is also lowered equal to the lowered extent of cutting drum 9 to depart further from the mine roof, thus causing the reflected ray of ray projector 15A to be now received by the ray receiver 15B-2. As described above, a signal is then applied as an input to the controller 16-2, the neutral display lamp 18 is turned on, and the electromagnetic valve 17-2 is closed at the same time, thus causing the cutting drum 9 to be held at the position to be set. Accordingly, even if the height of mine roof changes, the mining height can be automatically kept constant by repeating the above described process.

An arrangement which is intended to manually raise or lower the cutting drum 9 arranged at the side of mine floor is shown in FIG. 4, for example. Description will be now made with reference to FIG. 4. In this embodiment, a lamp 19-1 for displaying the signal to raise the cutting drum, a lamp 19-2 for displaying the neutral signal and a lamp 19-3 for displaying the signal to lower the cutting drum 9 are arranged at a stage next to a controller 16, said controller 16 intended to detect the positions of the turning ray or wave receiver and to measure the distance to the mine roof. When the ray receiver receives the reflected ray of ray projector 15A at the position of 15B-1, 15B-2 or 15B-3 according to the height (b), (a) or (c) the mine roof, a signal is applied as an input to turn on any one of lamps 19-1, 19-2 and 19-3. Accordingly, the operator may manually operate the drum raising valve 17-1 or drum lowering valve 17-2 to always keep the neutral lamp 19-2 turned on.

Though the present invention has been described in detail, it includes the following other embodiments:

(1) In the shearer having one ranging arm 5 which is provided with two cutting drums 9, the sensor attaching board 12 is mounted, as shown in FIG. 1, on the shaft to which the cutting drum to be arranged at the side of mine floor is attached.

(2) In the double ranging drum shearer as shown in FIG. 1, the device for detecting the position of a cutting drum according to the present invention is also arranged to the ranging arm 4 to which the cutting drum to be arranged at the side of the mine roof is attached, so that either of cutting drums 8 and 9 can be used as the lower cutting drum reciprocating the shearer body 1 along the long wall pit face.

(3) The shearer is a single ranging one having no ranging arm 4 to which the cutting drum to be arranged at the side of mine roof is attached as shown in FIG. 1.

(4) Point (B) is not positioned on the drum rotating shaft 10, but is displaced a little to the side of point (A) on a line connecting points (B) and (A), and correction of measured values is made by the controllers 16-1, 16-2 and 16-3.

(5) Lines connecting points (A), (B), (C) and (D) do not form a correct parallel link means, but a quasi-parallel link means capable of keeping the measurement errors of the sensor smaller than several centimeters, preferably five centimeters.

Figure 5:
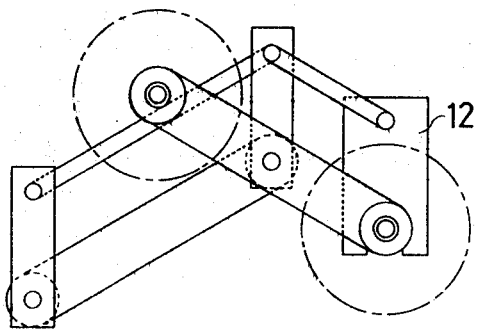
FIG. 5 is a front view showing another embodiment of present invention.

(6) As disclosed in the Japanese Patent Publication No. 78-4043, the shearer has a main ranging arm to which a sub-ranging arm is attached, and two cutting drums are attached to both ends of the sub-ranging arm. In this case, two parallel links are formed as shown in FIG. 5 and the sensor attaching board 12 is mounted on the shaft to which the cutting drum to be arranged at the side of the mine floor is attached. When either the main or sub-ranging arm is fixed, it is enough to form one parallel link.

(7) A plurality of sensors 15 are attached to the board 12 and the average of values measured by these sensors 15 is employed to represent the distance to the mine roof.

(8) One end of link bar 14 is pivoted to the shearer body 1.

(9) A plurality of position detection devices are arranged to prevent the ray or wave from being intercepted by any obstacle at the mining site.

It is thought that the present invention can be applied as follows:

(1) The board 12 and the parallel link means employed in the present invention are omitted. The sensor 15 is mounted on the drum rotating shaft 10 to detect at the same time the angle at which the ray or wave is projected from the sensor and the distance to the mine roof at the angle, and the distance vertically extending to the mine roof is calculated by the controllers 16-1, 16-2 and 16-3, thus enabling the jack 7 to be operated manually or automatically.

(2) Instead of board 12 and parallel link means employed in the present invention, other publicly well-known levels which use the surface of liquid or a float, or are of hanging or swinging weight type, or of gyro-type for example, are employed and the sensor 15 is attached to one of these levels.

(3) Instead of ray or wave projector and receivers employed as the sensor in the present invention, other publicly well known sensors such as the one disclosed in the publicly opened Japanese Pat. No. 958,841 can be employed.

The coal mining machine according to the present invention and having such arrangements as described above can be operated as follows:

When the shearer body 1 is moved along the long wall pit face in the direction shown by an arrow in FIG. 1, the ranging arm 4 is turned in the upper direction to determine the position of cutting drum 8 which is intended to cut the coal seam at the side of the mine roof, and then the coal seam at the side of mine roof is cut by the cutting drum 8. The coal seam at the side of the mine floor is cut by the following lower cutting drum 9 in such a way that the sensor 15 measures the distance to the mine roof as described above, namely the distance to the roof of the coal seam which has been cut by the preceding upper cutting drum 8, and the cutting drum 9 is manually or automatically raised or lowered according to the height of the mine roof. Accordingly, the mining height can be always kept constant.

Since the present invention can provide the above mentioned arrangements and operational functions, the objects of present invention can be attained. Namely, since the sensor for measuring the distance to the mine roof is arranged to the lower cutting drum, the distance to the mine roof can be accurately measured at the time of cutting the coal seam at the side of the mine floor. Since the sensor is attached to the board which is kept moving in the vertical direction even if the ranging arm is rotated in the upper or lower direction, measurement errors are not caused because the sensor is not slanted as the conventional sensors are. Since the parallel link means is employed as a means to keep the sensor attaching board level, the sensor can be accurately operated even if violent vibration and impact of crumbling lumps and scattering pieces of coal are imparted to the shearer at the mining site. In addition, since the ray or wave projector and receivers are employed as the sensor, the distance to the mine roof can be accurately measured even if the distance between the mine roof and the lower cutting drum is great, and accidents can be substantially reduced as compared with the conventional sensors which are designed to contact and follow the mine roof.

What is claimed is:

1. A mining apparatus comprising (A) an apparatus body, (B) a drum rotating shaft, (C) a board connected to said rotating shaft, (D) a linking bar pivotably connecting said apparatus body with said board, (E) a position detection device mounted on said board comprising at least one projector and at least one receiver, said position detection device measuring the position of said apparatus in a mine by receipt of projected signals reflected off an edge of said mine.

2. An apparatus of claim 1 wherein said position detection device is mounted on said board at a distance away from the edge of said mine.

3. An apparatus of claim 2 wherein the position detection device senses light rays.

4. An apparatus of claim 1 additionally comprising a ranging arm pivotally connecting said rotating drum shaft with said apparatus body and adapted to move substantially in concert with said linking bar.

5. An apparatus of claim 4 wherein said linking bar is substantially rigid.

6. An apparatus of claim 5 wherein said ranging arm and said linking bar are adapted to move substantially parallel to one another.

7. An apparatus of claim 5 wherein said linking bar and said ranging arm are connected to a fixed plate of said apparatus body which together with said board, said linking bar and said ranging arm, substantially forms a parallelogram on movement of said latter three components.

8. An apparatus of claim 4 wherein said ranging arm is attached to two drum rotating shafts and said position detection device is adapted to detect position of at least one cutting drum mounted on said drum rotating shafts.

9. An apparatus of claim 8 wherein said position detection device is adapted to detect position of said cutting drums mounted on both of said drum rotating shafts.

10. An apparatus of claim 1 wherein the position detection device senses sound waves.

11. An apparatus of claim 1 wherein the position detection device comprises a plurality of receivers.

12. An apparatus of claim 1 comprising a plurality of position detecting devices.

13. An apparatus of claim 1 for mining coal.

* * * * *